US009407383B2

(12) United States Patent
Milbar et al.

(10) Patent No.: US 9,407,383 B2
(45) Date of Patent: Aug. 2, 2016

(54) APPARATUS AND METHOD FOR DISTRIBUTING CONTENT FROM AN HD RADIO SYSTEM

(71) Applicant: iBiquity Digital Corporation, Columbia, MD (US)

(72) Inventors: Marek Milbar, Huntingdon Valley, PA (US); Ashruf El-Dinary, Clarksville, MD (US); Jeffrey R. Detweiler, Ellicott City, MD (US)

(73) Assignee: iBiquity Digital Corporation, Columbia, MD (US)

( * ) Notice: Subject to any disclaimer, the term of this patent is extended or adjusted under 35 U.S.C. 154(b) by 0 days.

(21) Appl. No.: 14/581,291

(22) Filed: Dec. 23, 2014

(65) Prior Publication Data

US 2016/0182171 A1 Jun. 23, 2016

(51) Int. Cl.
*H04H 20/71* (2008.01)
*H04H 20/72* (2008.01)

(52) U.S. Cl.
CPC ..... *H04H 20/72* (2013.01)

(58) Field of Classification Search
CPC ..... H04H 20/30; H04H 2201/183; H04H 2201/20; H04H 2201/186; H04H 20/28; H04H 2201/18; H04N 21/235; H04N 21/2368
USPC ..... 455/3.01
See application file for complete search history.

(56) References Cited

U.S. PATENT DOCUMENTS 5,315,583 A * 5/1994 Murphy ..... H04H 20/31 370/312
5,333,155 A 7/1994 Dambacher
5,822,324 A * 10/1998 Kostresti ..... H04L 65/604 348/E5.002
6,256,509 B1 7/2001 Tanaka et al.
6,625,421 B1 9/2003 Harada et al.
6,697,603 B1 2/2004 Lovinggood et al.
6,725,035 B2 4/2004 Jochim et al.
6,785,558 B1 8/2004 Stratford et al.
7,352,817 B2 4/2008 Milbar
8,027,419 B2 9/2011 Iannuzzelli et al.
8,041,292 B2 10/2011 Milbar
8,279,908 B2 10/2012 Iannuzzelli et al.
8,457,081 B2 6/2013 Huang et al.
8,731,030 B1 5/2014 McDonald et al.
8,774,109 B2 7/2014 Kenington et al.
2004/0063399 A1* 4/2004 Milbar ..... H03M 13/271 455/3.01
2009/0290602 A1* 11/2009 McNeely ..... H04B 7/18526 370/537
2012/0028567 A1* 2/2012 Marko ..... H04W 4/20 455/3.02
2013/0021193 A1 1/2013 Hermsen et al.
2013/0265918 A1 10/2013 Balasubramanian et al.
2014/0331111 A1 11/2014 Kroeger et al.

OTHER PUBLICATIONS

"In-Band/On-Channel Digital Radio Braodcasting Standard", NRSC-5-C, National Radio Systems Committee, Washington, DC, Sep. 2011.

* cited by examiner

*Primary Examiner* — Don N Vo
(74) *Attorney, Agent, or Firm* — Robert P. Lenart, Esq.; Pietragallo Gordon Alfano Bosick & Raspanti, LLP

(57) ABSTRACT

A translator includes: an input configured to receive a bit stream having a plurality of digitally encoded contents and control information; processing circuitry configured to select one of the digitally encoded contents, to use the selected digitally encoded content to produce an analog modulated signal, to use the digitally encoded contents to produce a digitally modulated signal, and to combine the analog modulated signal and the digitally modulated signal to produce a hybrid signal; and an output configured to output the hybrid signal. A method performed by the radio signal translator is also provided.

20 Claims, 8 Drawing Sheets

APPARATUS AND METHOD FOR DISTRIBUTING CONTENT FROM AN HD RADIO SYSTEM

FIELD OF THE INVENTION

This invention relates to apparatus and methods for distributing content from an HD Radio™ system.

BACKGROUND OF THE INVENTION

The iBiquity Digital Corporation HD Radio system is designed to permit a smooth evolution from current analog amplitude modulation (AM) and frequency modulation (FM) radio to a fully digital in-band on-channel (IBOC) system. This system delivers digital audio and data services to mobile, portable, and fixed receivers from terrestrial transmitters in the existing medium frequency (MF) and very high frequency (VHF) radio bands. Broadcasters continue to transmit analog AM and FM simultaneously with the new, higher-quality and more robust digital signals, allowing themselves and their listeners to convert from analog to digital radio while maintaining their current frequency allocations.

The National Radio Systems Committee, a standard-setting organization sponsored by the National Association of Broadcasters and the Consumer Electronics Association, adopted an IBOC standard, designated NRSC-5, the disclosure of which is incorporated herein by reference, which sets forth the requirements for broadcasting digital audio and ancillary data over AM and FM broadcast channels. The standard and its reference documents contain detailed explanations of the RF/transmission subsystem and the transport and service multiplex subsystems. A copy of the standard can be obtained from the NRSC at http://www.nrscstandards.org. iBiquity's HD Radio™ technology is an implementation of the NRSC-5 IBOC standard. Further information regarding HD Radio™ technology can be found at www.hdradio.com and www.ibiquity.com.

It is desirable to transmit the information content of HD Radio signals to users that are located beyond the range of an HD Radio transmitter. One method for transmitting HD Radio signals to contiguous locations implements an HD Radio broadcast system as a single frequency network (SFN). U.S. Pat. No. 8,279,908 discloses a single frequency HD Radio network, and is hereby incorporated by reference. Generally, a single frequency network is a broadcast network where several transmitters simultaneously send the same signal over the same frequency channel. Analog FM and AM radio broadcast networks, as well as digital broadcast networks, can operate in this manner. One aim of SFNs is to increase the coverage area and/or decrease the outage probability, since the total received signal strength may increase at positions where coverage losses due to terrain and/or shadowing are severe. SFN's and other known translational distribution networks require stringent time alignment of the components of an HD Radio signal.

Another method for distributing content to remote broadcasters is described in US Patent Application Publication No. 2013/0265918, titled "Broadcast Equipment Communications Protocol", which is hereby incorporated by reference. That patent application includes a description of an HD Radio protocol that can be used to transmit content to remote broadcasters.

SUMMARY OF THE INVENTION

In a first aspect, the invention provides a translator including: an input configured to receive a bit stream having a plurality of digitally encoded contents and control information; processing circuitry configured to select one of the digitally encoded contents, to use the selected digitally encoded content to produce an analog modulated signal, to use the digitally encoded contents to produce a digitally modulated signal, and to combine the analog modulated signal and the digitally modulated signal to produce a hybrid signal; and an output configured to output the hybrid signal.

In another aspect, the invention provides a method of distributing content including: receiving a bit stream having a plurality of digitally encoded contents and control information; selecting one of the digitally encoded contents; using the selected digitally encoded content to produce an analog modulated signal; using the digitally encoded contents to produce a digitally modulated signal; combining the analog modulated signal and the digitally modulated signal to produce a hybrid signal; and outputting the hybrid signal.

In another aspect, the invention provides another method of distributing content. The method includes: transmitting a bit stream of unmodulated HD Radio Layer 2 data over a network, the data representing a plurality of digitally encoded contents and control information formatted according to an HD Radio protocol; receiving the unmodulated HD Radio Layer 2 data at a player; using processing circuitry in the player to decode the bit stream to recover the contents and control information; supplying user commands to the processing circuitry; and producing an audio output based on one of the contents in response to the user commands.

DETAILED DESCRIPTION OF THE INVENTION

In one aspect, this invention relates to a method and apparatus for remotely distributing content, which is provided by a content source, such as an in-band on-channel (IBOC) radio broadcaster, network operations center, or other content provider.

Figure 1:
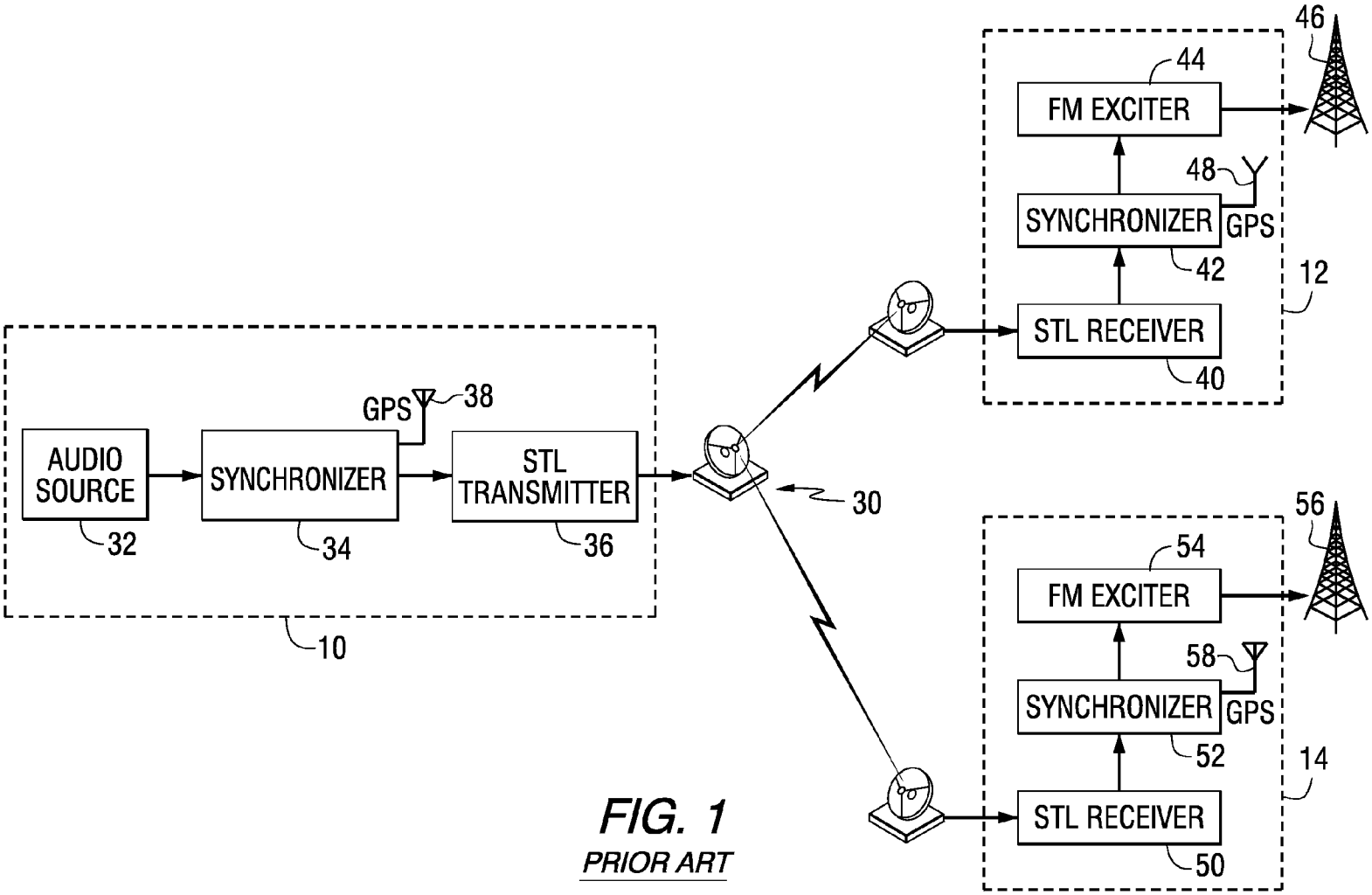
FIG. 1 PRIOR ART
FIG. 1 is a block diagram of a prior art single frequency network.

One known technique for transmitting the information content of HD Radio signals to users that are located beyond the range of an HD Radio transmitter uses a single frequency network (SFN). FIG. 1 shows a basic conceptual diagram of a prior art IBOC SFN. In FIG. 1 a studio transmitter link (STL) 30 between a first transmitter (e.g., the studio) and a plurality of remote transmitters can be a microwave link, T1 line, satellite, cable, etc. A studio 10 is shown to include an audio source 32, a synchronizer 34 and an STL transmitter 36. The synchronizer 34 receives a timing signal from a global positioning system (GPS) as illustrated by GPS antenna 38.

The timing signals from the global positioning system serve as a master clock signal. The transmitters are also referred to as platforms.

Station 12 is shown to include an STL receiver 40, a synchronizer 42, an exciter 44, and an antenna 46. The synchronizer 42 receives a timing signal from the global positioning system (GPS) as illustrated by GPS antenna 48.

Station 14 is shown to include an STL receiver 50, a synchronizer 52, an exciter 54, and an antenna 56. The synchronizer 52 receives a timing signal from the global positioning system (GPS) as illustrated by GPS antenna 58. The timing signals from the global positioning system serve as a master clock signal.

Figure 2:
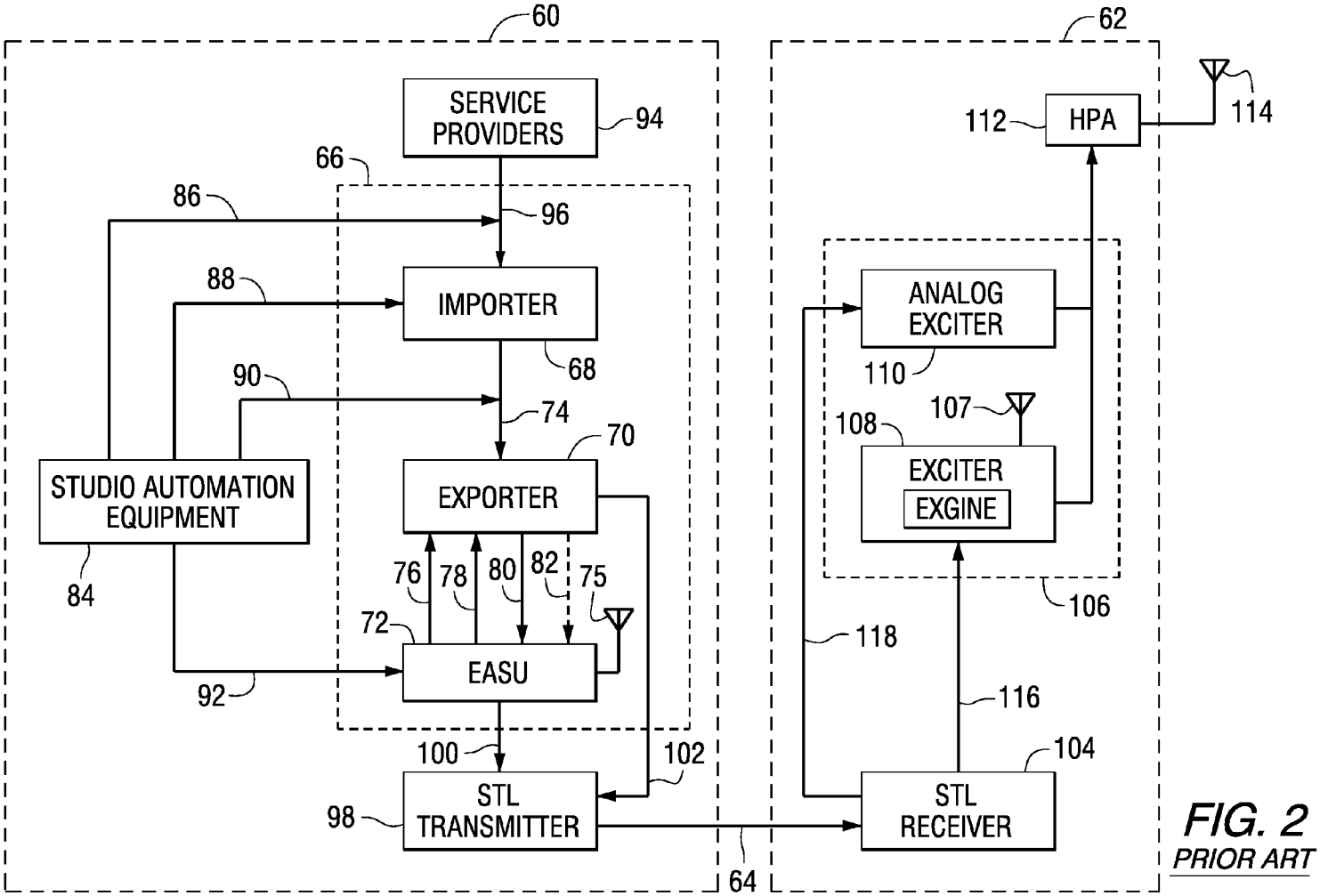
FIG. 2 PRIOR ART
FIG. 2 is a block diagram of a prior art IBOC radio broadcasting system.

Some embodiments of the present invention utilize data frames or protocol data units produced in existing IBOC systems for the remote distribution of program content. FIG. 2 is a block diagram of relevant components of a prior art studio site 60, an FM transmitter site 62, and a studio transmitter link (STL) 64 that can be used to broadcast an FM IBOC signal. The studio site includes, among other things, studio automation equipment 84, an importer 68, an exporter 70, an exciter auxiliary service unit (EASU) 72, and an STL transmitter 98. The transmitter site includes an STL receiver 104, a digital exciter 106 that includes an exciter engine subsystem 108, and an analog exciter 110.

At the studio site, the studio automation equipment supplies main program service (MPS) audio 92 to the EASU, MPS data 90 to the exporter, supplemental program service (SPS) audio 88 to the importer, and SPS data 86 to the importer. MPS audio serves as the main audio programming source. In hybrid modes, it preserves the existing analog radio programming formats in both the analog and digital transmissions. In all-digital modes, only digitally modulated subcarriers are transmitted. MPS data, also known as program service data (PSD), includes information such as music title, artist, album name, etc. The supplemental program service can include supplementary audio content, as well as program associated data for that service.

The importer contains hardware and software for supplying advanced application services (AAS). A "service" is content that is delivered to users via an IBOC broadcast signal and can include any type of data that is not classified as MPS or SPS. Examples of AAS data include real-time traffic and weather information, navigation map updates or other images, electronic program guides, multicast programming, multimedia programming, other audio services, and other content. The content for AAS can be supplied by service providers 94, which provide service data 96 to the importer. The service providers may be a broadcaster located at the studio site or externally sourced third-party providers of services and content. The importer can establish session connections between multiple service providers. The importer encodes and multiplexes service data 86, SPS audio 88, and SPS data 96 to produce exporter link data 74, which is output to the exporter via a data link.

The exporter 70 contains the hardware and software necessary to supply the main program service (MPS) and station information service (SIS) for broadcasting. SIS provides station information, such as call sign, absolute time, position correlated to GPS, etc. The exporter accepts digital MPS audio 76 over an audio interface and compresses the audio. The exporter also multiplexes MPS data 90, exporter link data 74, and the compressed digital MPS audio to produce exciter link data 102. In addition, in FM transmission systems, the exporter accepts analog MPS audio 78 over its audio interface and applies a pre-programmed delay to it, to produce a delayed analog MPS audio signal 80 which may be passed through the EASU by-pass switch and output to the STL transmitter as signal 100 or may be otherwise provided directly to the STL transmitter. This analog audio can be broadcast as a backup channel for hybrid IBOC broadcasts. The delay compensates for the system delay of the digital MPS audio, allowing receivers to blend between the digital and analog program without a shift in time. In an AM transmission system, the delayed MPS audio signal 90 is also converted by the exporter to a mono signal. The delayed MPS audio is sent directly to the studio to transmitter link (STL) as part of the exciter link data 102.

The EASU 72 accepts MPS audio 92 from the studio automation equipment, rate converts it to the proper system clock, and outputs two copies of the signal, one digital 76 and one analog 78. The EASU includes a GPS receiver that is connected to an antenna 75. The GPS receiver allows the EASU to derive a master clock signal, which is synchronized to the exciter's clock. The EASU provides the master system clock used by the exporter. The EASU provides the analog MPS audio 100 to the STL transmitter. The EASU is also used to bypass (or redirect) the analog MPS audio 92 from being passed through the exporter and provided as delayed analog MPS audio 80, in the event the exporter has a catastrophic fault and is no longer operational. The bypassed audio can be fed directly as signal 100 into the STL transmitter, eliminating a dead-air event. In other embodiments, the EASU clocking and synchronization function can be incorporated into the Exporter hardware.

The STL transmitter 98 receives a delayed analog MPS audio bit stream 100 and exciter link data 102. It outputs exciter link data and delayed analog MPS audio over STL link 64, which may be either unidirectional or bidirectional. The STL is required to maintain the provided time alignment between the digital MPS audio and the delayed analog MPS audio. The STL link may be a digital microwave or Ethernet link, for example, and may use the standard User Datagram Protocol (UDP) or the standard Transmission Control Protocol (TCP).

The transmitter site includes an STL receiver 104, an exciter 106 which includes digital signal exciter 108 and an analog signal exciter 110. The STL receiver 104 receives exciter link data, including audio and data signals as well as command and control messages, over the STL link 64. The exciter link data is passed to the exciter 106, which produces the IBOC waveform. The exciter includes a host processor, digital up-converter, RF up-converter, and exgine subsystem 108. The exgine (digital signal exciter 108) accepts exciter link data and modulates the digital portion of the IBOC DAB waveform. The digital up-converter of exciter 106 converts the baseband portion of the exgine output from digital-to-analog. The digital-to-analog conversion is based on a GPS clock, common to that of the exporter's GPS-based clock, derived from the EASU. Thus, the exciter 106 also includes a GPS unit and antenna 107.

The RF up-converter of the exciter up-converts the analog signal to the proper in-band channel frequency. The up-converted signal is then passed to the high power amplifier 112 and antenna 114 for broadcast. Separately, in FM transmission systems, the exciter link data is passed to the analog exciter 110. The analog exciter 110 accepts exciter link data and modulates the analog portion of the IBOC waveform. In an AM transmission system, the exgine subsystem coherently adds the backup analog MPS audio to the digital waveform in the hybrid mode; thus, the AM transmission system does not include the analog exciter 110. In addition, the exciter 106 produces phase and magnitude information and the digital-to-analog signal is output directly to the high power amplifier.

Figure 3:
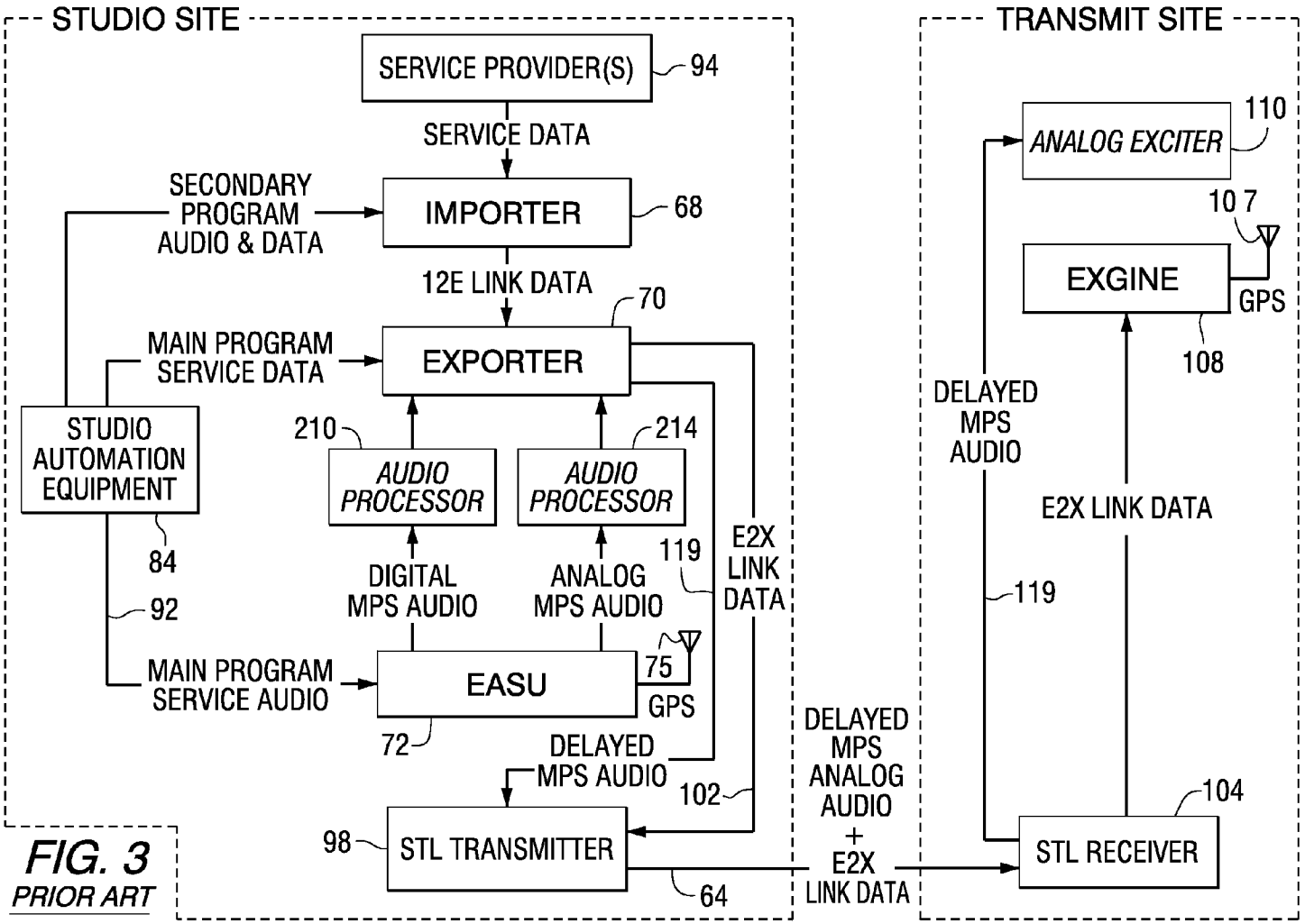
FIG. 3 PRIOR ART
FIG. 3 is a block diagram of another IBOC radio broadcasting system.

FIG. 3 is a block diagram of another IBOC radio broadcasting system, wherein elements having the same function as in FIG. 2 have the same item numbers in FIG. 3. In the system of FIG. 3, digital MPS audio is processed by an audio processor 210 before being delivered to the exporter and analog MPS audio is processed by an audio processor 214 before being delivered to the exporter. The delayed analog audio 119 is then provided by the exporter directly to the STL transmitter.

IBOC broadcasting systems that operate in a hybrid mode transmit program material on both an analog modulated carrier and a plurality of digitally modulated carriers. Generally, the main program content is transmitted on the analog modulated carrier and a digital version of the main program is transmitted on a plurality of digitally modulated carriers. Additional program contents can also be transmitted on the digitally modulated carriers. Conventional receivers are capable of receiving the main program content on the analog modulated carrier. HD Radio receivers receive both the main program content on both the analog modulated carrier and the digitally modulated carriers, as well as any additional program content on the digitally modulated carriers. IBOC broadcasting systems that operate in an all-digital mode transmit program material on a plurality of digitally modulated sub-carriers.

The digital signal is modulated using Orthogonal Frequency Division Multiplexing (OFDM). OFDM is a parallel modulation scheme in which the data stream modulates a large number of orthogonal sub-carriers, which are transmitted simultaneously. OFDM is inherently flexible, readily allowing the mapping of logical channels to different groups of sub-carriers.

In the described embodiments, the digital channel that is used to transmit the main program content is referred to as the HD1 channel. Additional channels that are used to transmit additional program content are referred to as HD2, HD3 and HD4. HD1 can have the same program content as that transmitted on the convention analog modulated signal. Conventional analog radio receivers demodulate the analog modulated carrier to retrieve program content. HD Radio receivers demodulated both the analog modulated carrier and the digitally modulated carriers to retrieve program content.

In one aspect, the present invention provides a translator that can be used when distributing content from a source broadcaster or other content source to one or more remote broadcasters, without requiring any time alignment of the audio content in the STL, that is intended for the analog and digitally modulated signals in a hybrid IBOC signal. In addition, when program content is rebroadcast at a remote location, it is possible that the intended audience may be more interested in channel HD2, HD3 or HD4 program content, rather than the programs content that is broadcast on the analog modulated carrier and channel HD1 of the source broadcaster. In embodiments of the invention, a translator can use the contents of channels HD2, HD3 or HD4 to modulate an analog carrier at the remote location, thus allowing conventional analog receivers to receive content that was only broadcast on digitally modulated carriers of the source broadcaster.

Figure 4:
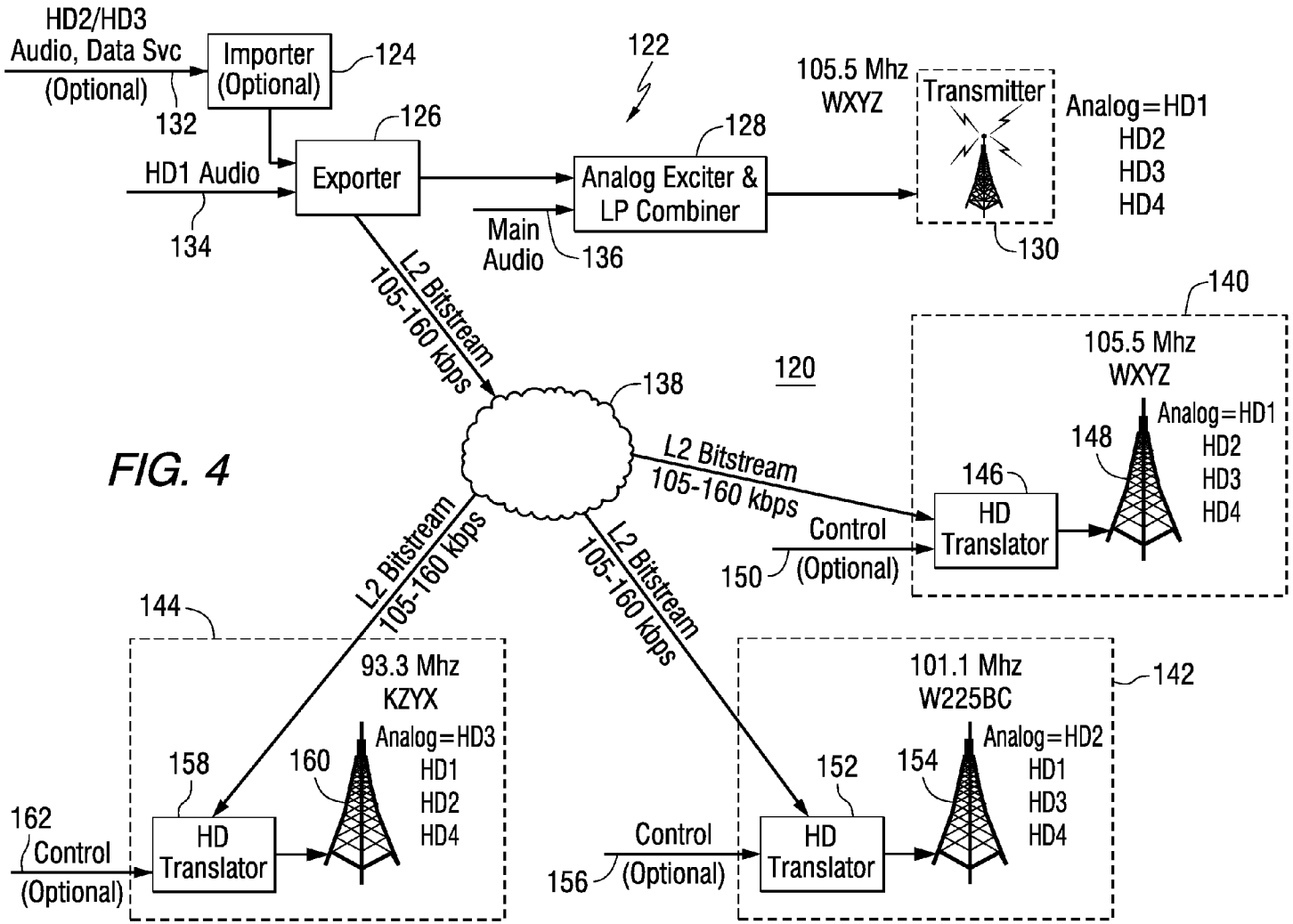
FIG. 4 is a block diagram of radio broadcasting system in accordance with an embodiment of the invention.

FIG. 4 shows a basic conceptual diagram of a broadcast network 120 in accordance with an embodiment of the invention. In this figure an HD Radio broadcaster 122 (referred to herein as the source broadcaster) includes (among other items not shown in this figure, but well known in the art) an importer 124, and exporter 126, an analog exciter, digital exciter and low power combiner 128, and a transmitter 130. Optional HD2/HD3 audio and data sync information can be supplied to the importer on line 132. HD1 audio is supplied to the exporter on line 134. Main analog audio is supplied to the analog exciter and low power combiner on line 136.

The content source supplies a multiplexed bit stream (referred to herein as the L2 bit stream) to a network 138, such as the Internet. The bit stream can include data frames or protocol data units produced at the source broadcaster. The L2 bit stream represents program content that are intended to be broadcast or otherwise transmitted by the source broadcaster or content source, and can include program content from a plurality of channels including the MPS program intended to be broadcast on channel HD1 of the digitally modulated carriers and also on the analog modulated carrier of the source broadcaster and programs intended to be broadcast only on the digitally modulated carriers of the source broadcaster on channels HD2, HD3, HD4 etc. In one embodiment, the L2 bit stream can include program content provided by the exporter on line 102 and then on line 64 of the transmitter of FIG. 2, but without including the delayed analog MPS audio content provided on line 100, and can include additional control information. In one embodiment, the L2 bit stream can include program content provided by the exporter on line 102 and then on line 64 of the transmitter of FIG. 3, but without including the delayed analog MPS audio content provided on line 119, and can include additional control information In one example, the L2 (multiplex layer) bit stream is transmitted at a rate of between 105 kbps and 160 kbps (for 96 kbps to 145 kbps system throughput). The L2 multiplexed bit stream which can include program content for multiple channels, can include the same frames that are used by the exporter and then by the physical layer for generating the digital waveform at the source broadcaster transmitter 130. In one example, L2 content distribution occurs about every 1.5 seconds for each modem frame.

Another embodiment can utilize a higher quality bit stream of L2 with each stream encoded at the maximum HDC coding rate (~128 kb/s). While an HD Radio digital system may only transmit a maximum of 96 kbs on any given channel, the higher bit rate would afford a signal routed to the analog broadcast path maximum fidelity. Each of the subsequent digital channels (HD1, HD2, etc. can be decimated to the target bitrate for each sub-channel. In other words; all the audio channels can be coded at 128 kbps (per channel) and a user can decide where and at what bit rate it is assigned in the Exporter and Importer function. In this case, the L2 Bitstream rates can be increased to a rate on the order of 512 kbs maximum (e.g., for four streams of content, or for eight streams in the all-digital MS1-4 modes).

The L2 bit stream can be accessed by one or more remote broadcasters. In the example of FIG. 4, the bit stream is shown to be accessed by three low power remote broadcasters 140, 142 and 144 (also referred to a translator sites). As further described below, remote broadcaster 140 performs a gap bridging function, remote broadcaster 142 performs a micro-space distribution, and remote broadcaster 144 functions as a remote station. However, the number of remote broadcasters that can access the bit stream is not limited, and FIG. 4 merely illustrates three types of remote broadcasters.

At each of the remote broadcasters, an HD translator receives the multiplexed L2 bit stream as generated by the exporter on line 102 and then provided on line 64 and uses the information in the bit stream to modulate the digitally modulated carriers and the analog modulated carrier of a hybrid radio signal. Then a transmitter transmits the hybrid radio signal.

Remote broadcaster 140 serves as a gap bridging broadcaster. That is, it is used to transmit the same program content on the same channel as the source broadcaster 122. This allows the reception of these signals in gap areas that are not within the adequate coverage of source broadcaster 122.

In remote broadcaster 140, a translator 146 uses the main program content of the HD1 channel to analog modulate the analog FM carrier, and uses the content of the channels HD1, HD2, HD3, and HD4 to digitally modulate a plurality of carriers. The analog modulated carrier and the digitally modulated carriers are combined to produce a hybrid signal that includes the analog channel and, optionally, the exact same digital HD1, HD2, HD3 and HD4 channels and is transmitted by a low power transmitter 148. This is referred to a gap bridging application because the transmitted signal fills a coverage gap while it uses the same content to modulate the analog modulated signal and digitally modulated carriers as the source broadcaster. Optional control information can be supplied to the HD translator 140 on line 150. Optional control information for broadcaster 140 can include, for example, information relating to the selection of the power level of the transmitted analog modulated carrier, and/or information relating to the selection of the power level of the transmitted digitally modulated carriers, and/or audio processing information.

In remote broadcaster 142, a translator 152 receives the L2 bit stream and uses the information in the bit stream to modulate carriers of a hybrid radio signal. Then the low power transmitter 154 transmits the hybrid radio signal. In this example, translator 152 uses the content of the HD2 channel to analog modulate the analog FM carrier, and uses the content of all the digital channels to digitally modulate a plurality of carriers. The analog modulated carrier and the digitally modulated carriers are combined to produce a hybrid signal that includes the analog HD2 channel and, optionally, the digital HD1, HD2, HD3 and/or HD4 channels and is transmitted by the antenna. In addition, in order to allow for the same audio content on the analog modulated carrier and the HD1 channel, the channel numbers of the originally provided HD1 and HD2 channels are swapped, thus the previously HD2 becomes HD1 and the previously HD1 becomes HD2. This broadcaster 142 is referred to as a microspace application that may reside within the original coverage area of the source broadcaster. Remote broadcaster 142 can be located at, for example, a sports venue, stadium, hall, facility or other location where the target audience is interested in the content originally broadcast on channel HD2 of the source broadcaster. Optional control information can be supplied to the HD translator 152 on line 156. Optional control information for broadcaster 142 can include, for example, information related to the selection of the program content that is to be transmitted using the analog modulated carrier, and/or information related to the selection of channels HD1, HD2, HD3 and HD4 that are to be transmitted using the digitally modulated carriers, and/or audio processing information, and/or information related to reordering of channels and/or metadata, and/or information related to inserts of data services, and/or information related to adjustments of the bit rates, and/or information relating to the selection of the power level of the transmitted analog modulated carrier, and/or information relating to the selection of the power level of the transmitted digitally modulated carriers.

At remote broadcaster 144, a translator 158 receives the bit stream and uses the information in the bit stream to modulate carriers of a hybrid radio signal. Then a high power transmitter 160 transmits the hybrid radio signal. In this example, translator 158 used the content of the HD3 channel to analog modulate a carrier, and uses the content of all the channels to digitally modulate a plurality of carriers. The analog modulated carrier and the digitally modulated carriers are combined to produce a hybrid signal that includes the analog HD3 channel and, optionally, the digital HD1, HD2, HD3 and/or HD4 channels and is transmitted by the antenna. In addition, in order to allow for the same audio content on the analog modulated carrier and the HD1 channel, the channel numbers of the originally provided HD1 and HD3 channels are swapped, thus the previously HD3 becomes HD1 and the previously HD1 becomes HD3. This is referred to as a distant remote station application because the transmitted signal provides broadcasting services outside the signal reception area of the source broadcaster and at any desired distance from the original broadcaster while it uses the L2 provided program content of one of the digital programs of the source broadcaster to modulate the analog modulated signal and, optionally, the L2 content to modulate the digitally modulated carriers. Optional control information can be supplied to the HD translator 158 on line 162.

FIG. 4 illustrates a cloud-suitable system for boosting, translating, and/or distributing all or part of the content that is broadcast by the source broadcaster. The analog signal produced by the translator at the remote broadcaster sites may be used to transmit the content of any of the source broadcaster HD1, HD2, HD3, or HD4 channels. The digital content of the channels can then be reordered for broadcasting having the same content on reordered HD1 channel and the analog FM signal. As both the analog modulated signal and the digitally modulated carriers are produced from the same L2 bit stream (as opposed to using signal 100 in prior art), the system is immune from being affected by cloud related propagation delays from the source broadcaster to the remote broadcaster. It then also allows receivers at the remote broadcaster using the analog modulated signal as a backup to the reordered HD1 channel, when receiving the IBOC hybrid signal.

Figure 5:
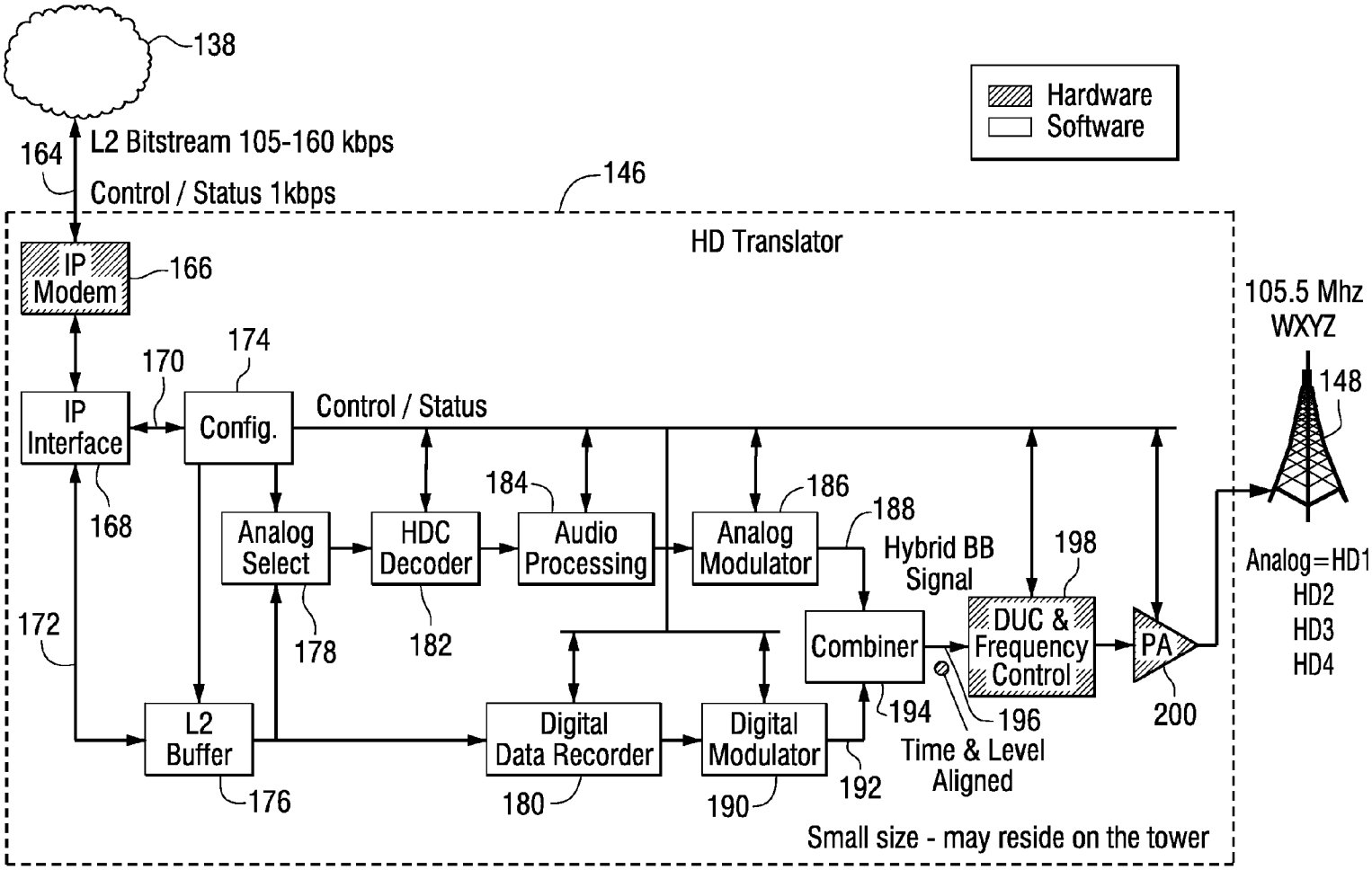
FIG. 5 is a block diagram of a translator that can be used in the system of FIG. 4.

FIG. 5 is a block diagram of the translator 146 in the remote broadcasters 140, 142 and 146 of the system of FIG. 4. The transmitter in the example of FIG. 4 uses the broadcast configuration of remote broadcaster 140. The translator includes an input 164 configured to receive a multiplexed (L2) bit stream from a network 138. The bit stream contains program content and control/status information. The control/status information can include, for example, information relating to the selection of the program content that is to be transmitted using the analog modulated carrier, audio processing information, information relating to reordering of content and/or metadata, information regarding the selection of inserts for data services, and/or information relating to adjustments of the bit rate, timing information, and/or broadcast signal power level information.

An IP modem 166 receives the bit stream and passes the digital information to an IP interface 168. The IP interface separates the digital information into control/status information on line 170 and the program content and/or data service content information on line 172. A configuration module 174 uses the control/status information to control multiple functions performed in the translator. An L2 buffer 176 stores the content information and delivers the program content information to an analog select module 178 and the entire content information to a digital data reorder module 180.

The operation of the L2 buffer and the analog select module is controlled by the configuration module. The analog select module selects the program content that will be used to modulate the analog modulated carrier that is to be transmitters by the transmitter 148. The content selected by the analog select module is passed to an HD Codec (HDC) decoder 182.

Then the decoded content is subject to audio processing 184 and analog modulation 186 to produce an analog modulated signal on line 188.

Reordered digital data from the reorder module 180 is used to modulate a plurality of carriers in the digital modulator 190 to produce a plurality of digitally modulated carriers on line 192. Combiner 194 combines the analog modulated carrier and the digitally modulated carriers to produce a hybrid baseband signal on output line 196. A digital upconverter and frequency control 198 converts the baseband signal to a radio frequency hybrid signal that is amplified by a power amplifier 200 and transmitted by transmitter 148.

In one embodiment of the translator of FIG. 5, the functions performed in blocks 168, 174, 176, 178, 180, 182, 184, 186, 190, and 194 can be implemented in software using one or more processors.

While FIG. 5 shows the translator 146 used in the gap bridging remote broadcaster of FIG. 4, it will be apparent to those skilled in the art that the same translator can be used in micro-space remote broadcasters, remote station broadcasters, or other remote broadcasters, with the content selected for the analog modulated signal and the content configuration for the digitally modulated carriers being chosen to provide the most appropriate signal for the target audience at the remote broadcaster.

Various embodiments can provide advantages over traditional translators and methods of distributing content. Remote broadcasters can be suitable for use in traditional single frequency networks as well as for micro-space signal distribution. The remote broadcasters can receive the same encapsulated data as is used by the source broadcaster, but with the advantage of not being dependent anymore on the previously required parallel distribution of the analog audio (signal 100 in FIG. 2.; signal 119 in FIG. 3) for modulating the analog FM signal. By not requiring the parallel distribution of the analog audio the remote broadcasters are not being adversely affected (and often prohibited) anymore by varying distribution propagation delays between that analog audio and the digital content that is used for modulating the digital carriers. In addition, by not requiring the parallel distribution of the analog audio, the remote broadcasters can individually change the configuration of the content of their remote broadcast, without requiring any changes in the distributed content from the source broadcaster.

Embodiments can provide remote broadcast of the source broadcaster programs with reduced costs for equipment, deployment, content distribution and operation. Since microwave links are not required, reliability may be improved. In addition, since tandem coding is not required, audio quality may be improved.

Embodiments can be implemented without distance limitations, as distribution requires only the digital content single bit stream and thus is not affected by distribution propagation delays over the cloud. The target translator/station may be anywhere on the globe. Instead of the source broadcaster shown in FIG. 4, the program content can be supplied by a network operations center (NOC). For example, the NOC could supply a multiplex bit stream that includes several program channels. Extended handling capabilities can be provided by the network operations center for control, diagnostics and configuration. For NOC operations, centrally reformatted L2 for each translator can be considered additionally. If an HD Radio broadcaster is the content source, L2 content may be sent by the exporter 'as is' or reformatted for each translator. Translator oriented processing is minimal, making sense for sending the same L2 to all translators In the disclosed examples, content distribution can be over the Internet Protocol (IP). Content can be distributed using existing infrastructure, with only limited data reformatting at the translator. For example, station information service (SIS) information may need some bit replacements related to location and call sign.

At the remote transmitters, the analog host signal is generated from an HD Radio Codec (HDC). The selected HDC content (from HD1, HD2, HD3, and/or HD4) in L2 is decoded, resulting in a PCM signal. A complete hybrid signal can be generated as baseband samples (e.g., as a vector). Currently used digital up converters and power amplifiers may be employed. If the analog candidate content is changed, renumbering and reordering of the digital content may be needed.

Time alignment and level alignment are guaranteed. At the remote transmitters, the analog host signal is generated from the selected HDC content (from HD1, HD2, HD3, and/or HD4) in L2. Therefore, no timing variations and no audio level variations occur between the audio provided over the analog modulated FM signal and the MPS audio content provided in the matching HD1 channel.

For some remote broadcasters, the control information never changes (i.e. static), so it may be included with the L2 data. In other instances, control information may be separately provided, as illustrated by the optional control inputs to the translators of FIG. 4. Various embodiments can be implemented using a 'Set-and-Forget' approach, not requiring prolonged maintenance. Configuration may be controlled over IP, if stations desire to modify it.

In addition to being part of the L2 bit stream, main program service audio can be sent as separate data. This would be unnecessary under most normal configurations, but may be considered when a low bit rate (such as for HD4) is the MPS candidate for a translator. A low bitrate can be used for an all-inclusive content distribution.

Various embodiments can be implemented to provide one or more of the following features: a fast 'plug-n-play' connection; low cost/no additional cost (where connectivity exists) operation at any distribution distance; employing older generation connectivity forms of IP; cheap auxiliary 'last mile' distribution if required; current streamers can have access to over the air broadcasting (Reverse tendency'); possible new uses for HD4 and/or HD5 channels; new content that is currently streamed only can be rebroadcast; low power FM ("LPFM") collaboration (where new HD3/HD4 content may be added for past LPFM seekers; better localization of localized broadcasting within the large service area; new HD3/HD4 channels may be added or replaced as suitable for specific locations (and advertisement); highway, park service or similar information may be provided through public stations or autonomously; event related services may be reconfigured as applicable, including commercially driven events such as concerts, sports, or sales; emergency events can be broadcast in collaboration with local authorities; and/or improved power management and co-existence.

Single digital sideband operation may be adequate for a limited coverage translator. In one embodiment, a single (optionally alternating) digital sideband along with L2 content over IP may solve frequency allocation and co-existence/interference issues. In one embodiment, two sidebands may be used but where each sideband is set to a different power level and the ratio between these power levels may be different from the ratio used by the HD Radio broadcaster.

In another aspect, the invention provides another method of distributing content directly to players over the Internet. The method includes: transmitting a bit stream of unmodulated HD Radio Layer 2 data over a network, the data representing a plurality of digitally encoded contents and control information formatted according to an HD Radio protocol; receiving the unmodulated HD Radio Layer 2 data at a player; using processing circuitry in the player to decode the bit stream to recover the contents and control information; supplying user commands to the processing circuitry; and producing an audio output based on one of the contents in response to the user commands. The player in this method is referred to as an HD Radio player. The HD Radio Player function may also be used for monitoring a station for proper multiplexing of audio and data services. In the program content production environment the HD Radio Player function may also be used to evaluate segment quality, e.g., to determine that PSD and data match the audio content and that it changes appropriately as content changes.

Figure 6:
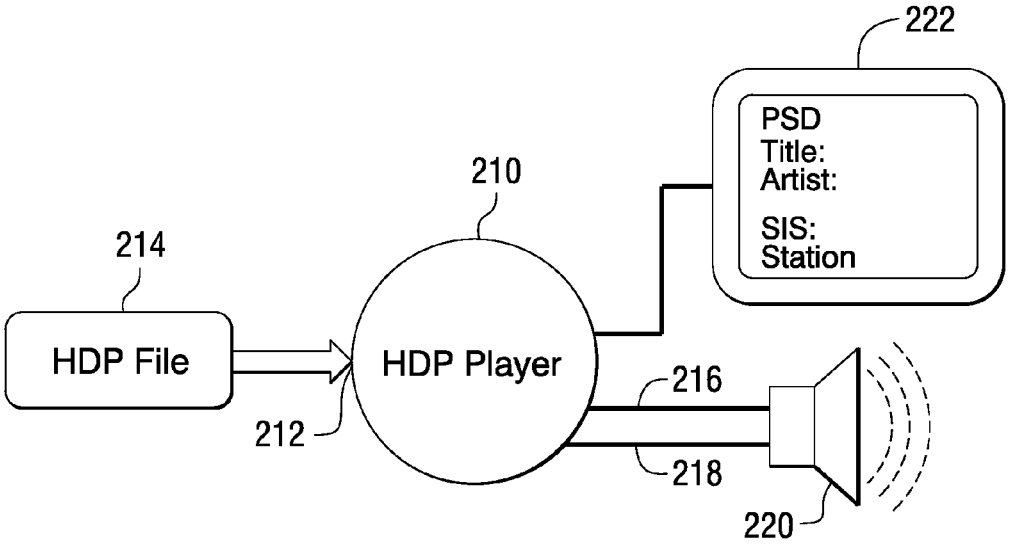
FIG. 6 is a block diagram of an HD Radio Protocol player 210.

FIG. 6 is a block diagram of an HD Radio player 210. The player includes an input 212 configured to receive data 214 formatted in accordance with the HD Radio protocol as described in US Patent Application Publication No. 2013/0265918. The data can be taken from Layer 2 (i.e., the multiplex layer) of the layered processing in an HD Radio broadcast. The layered signal processing used in HD Radio transmitters is described in U.S. Pat. No. 8,041,292, for a "Network Radio Receiver", which is hereby incorporated by reference.

The player 210 includes processing circuitry that decodes the HD Radio protocol input data to produce an audio signal on lines 216 and 218 that is used to produce an audio output from a transducer, such as a speaker 220. The processing circuitry can also produce information that can be shown on a user display or graphical user interface 222. In addition, the processing circuitry can receive user input from the graphical user interface, and respond to that user input, for example by extracting user requested information from the input data. The processing circuitry can include the processing elements illustrated in FIG. 12 of U.S. Pat. No. 8,041,292, for example.

Figure 7:
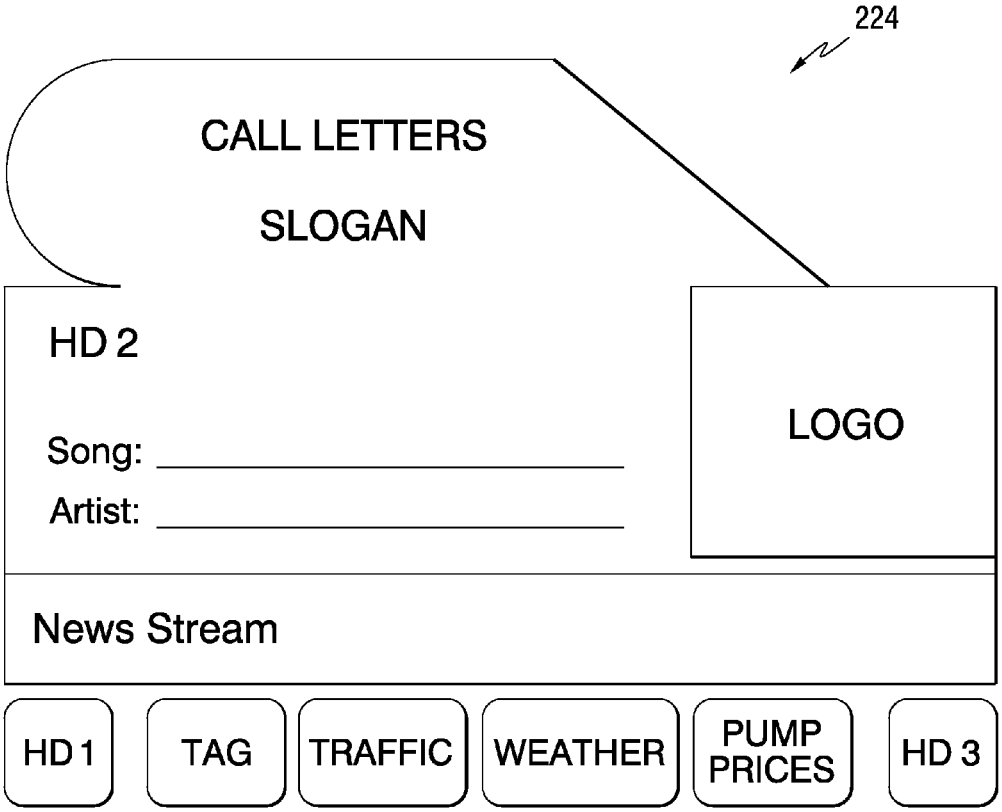
FIG. 7 is an example of a graphical user interface for an Internet player.

FIG. 7 is an example of a screen 224 that may be presented on the graphical user interface 222 for an Internet player. In this embodiment, the interface is configured to display the radio station call letters; the radio station slogan; the radio station logo; the HD subchannel that is currently being accessed by the user; the current song title and artist; a news stream; and a plurality of buttons that allow the user to select a different HD subchannel; to tag the received content; to request traffic information; to request weather information; and to request gas prices. When the user presses one of these buttons, the processing circuitry retrieves the requested content or information from the received data and produces an appropriate output for the speaker and/or user interface, based on the requested content.

Figure 8:
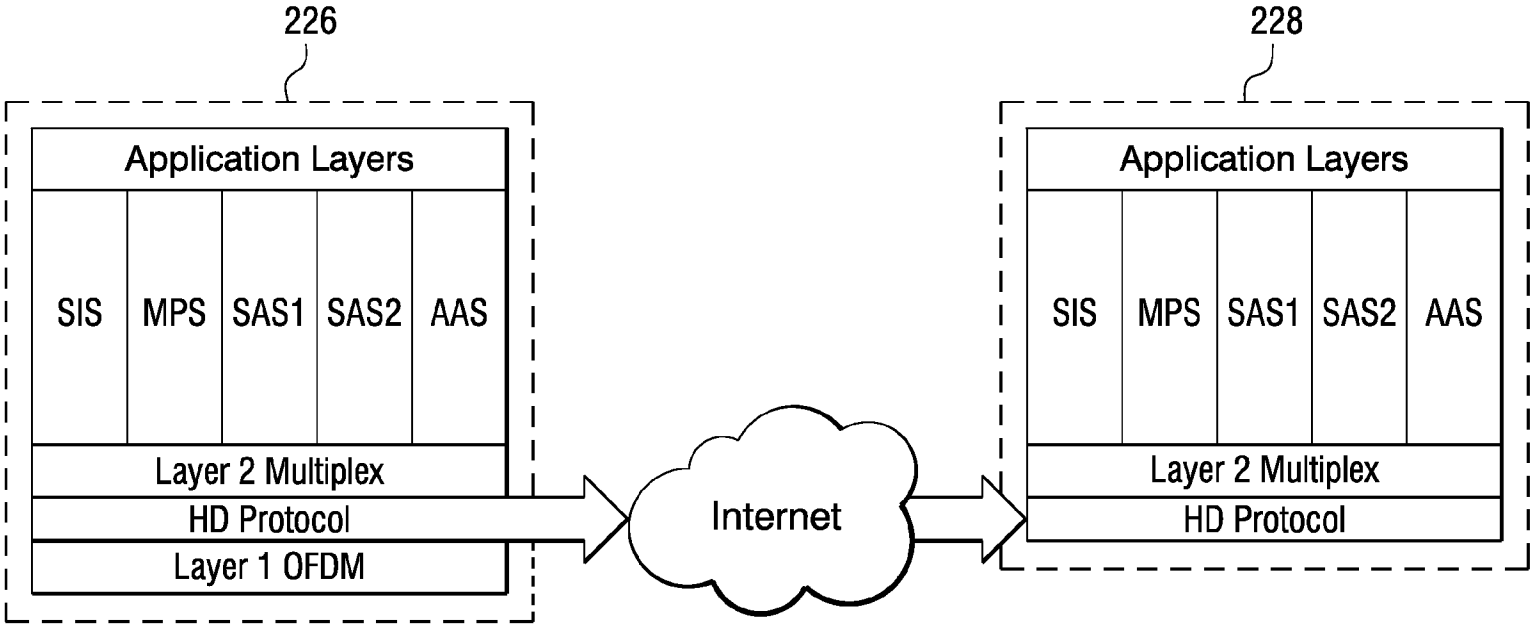
FIG. 8 is a schematic diagram of signal processing layers in a transmitter and an HD Radio player.

The HD Radio Protocol can be used to format and distribute HD Radio content over the Transmission Control Protocol/Internet Protocol (TCP/IP) or the User Datagram Protocol (UDP). FIG. 8 is a schematic diagram of signal processing layers in a transmitter 226 and an HD Radio player 228. At an HD Radio transmitter, content is processed in a plurality of applications layers to produce content that is multiplexed in Layer 2. The Layer 2 information is formatted according to an HD Radio Protocol and transmitted to the Internet. At the player, the HD Radio Protocol content is recovered from the Layer 2 data.

The processing circuitry passes decoded data to a user interface, which includes a display. Command and status information is also exchanged between the microprocessor and user interface. The user interface includes controls for activation by a user. These controls can allow the user to implement various functions such as changing the frequency of a received station, increasing or decreasing the volume of the audio output, selecting between main or secondary programs, responding to received data, utilizing an electronic program guide, or utilizing store-and-replay functionality, for example. The controls may be implemented using buttons, switches and other activation mechanisms, either alone or in combination with a software implemented graphical user interface.

An inter-component communications protocol at an HD Radio transmitter site allows the transmitter hardware (i.e., an importer, exciter, and exgine) to robustly send information over a network. The broadcaster sends the Layer 2 data (also called the E2X output) over TCP/IP. The signal can include bundled modem frames that are transmitted using the same bandwidth (e.g., 96 kbps-144 kbps) as for over-the-air transport. In addition, the system can use the same framing and formatting as the over-the-air transmission. The player includes a simplified processor that unbundles the E2X output and processes upper layers of the audio/data transports. Application specific modules can be provided to support traffic applications, such as those provided by the BTC or Clear Channel, as well as other applications. The technique may also be used to enhance weak radio frequency reception in some Internet connected radio products. While FIG. 8 shows the transmission of Layer 2 information, the technique may be applied at different layers of the system.

HD Radio players that process Layer 2 data streams received over the Internet can use a simplified upper layer processor to manage modem frame demultiplexing and audio/data transports. Such players can include a software application that unbundles these services into a graphical user interface that looks like a typical HD Radio receiver. This allows a user to identify bundled applications such as multicast audio, station identifications, news, traffic, weather, synchronized album art, and synchronized PSD, for example.

An HD Radio player can include: an input configured to receive a bit stream Layer 2 data representing a plurality of digitally encoded contents and control information formatted according to an HD Radio protocol; processing circuitry configured to decode the bit stream to recover the contents and control information; and a user interface configured to receive a portion of the contents and control information from the processing circuitry and to supply user commands to the processing circuitry; wherein the processing circuitry produces an audio output in response to the user commands.

While the invention has been described in terms of several examples, it will be apparent to those skilled in the art that various changes can be made to the disclosed examples without departing from the scope of the invention as defined by the following claims. The implementations described above and other implementations are within the scope of the claims.

What is claimed is:

1. A translator comprising:

an input configured to receive a bit stream having a plurality of digitally encoded contents and control information;

processing circuitry configured to select one of the digitally encoded contents, to use the selected digitally encoded content to produce an analog modulated signal, to use the digitally encoded contents to produce a digitally modulated signal, and to combine the analog modulated signal and the digitally modulated signal to produce a hybrid signal; and an output configured to output the hybrid signal.

2. The translator of claim 1, wherein:

the digitally encoded contents comprise protocol data units or data frames produced by a broadcast content source.

3. The translator of claim 2, wherein:

the protocol data units comprise layer 2 protocol data units.

4. The translator of claim 2, wherein the content source is an HD Radio broadcaster.

5. The translator in claim 4, wherein the processing circuitry selects digitally encoded content for the analog modulated signal that differs from the digitally encoded content used by the HD Radio broadcaster for a main program signal.

6. The translator of claim 2, wherein the content source is a network operations center.

7. The translator in claim 6, wherein the processing circuitry selects digitally encoded content for the analog modulated signal that differs from the digitally encoded content used by the network operating center for a main program signal.

8. The translator in claim 1, wherein the processing circuitry is further configured to:

reorder data in the digitally encoded contents; and replace bits in the digitally encoded contents.

9. The translator of claim 1, wherein the processing circuitry is configured to modify audio processing of the selected digitally encoded content.

10. A method of distributing content, the method comprising:

receiving a bit stream at an input of a translator, wherein the bit stream includes a plurality of digitally encoded contents and control information;

selecting one of the digitally encoded contents;

using the selected digitally encoded content to produce an analog modulated signal;

using the digitally encoded contents to produce a digitally modulated signal;

combining the analog modulated signal and the digitally modulated signal to produce a hybrid signal; and outputting the hybrid signal.

11. The method of claim 10, wherein:

the digitally encoded contents comprise protocol data units or data frames produced by a content source.

12. The method of claim 11, wherein the content source is an HD Radio broadcaster, and a configuration of digital sidebands in the hybrid signal of the remote broadcaster differs from a configuration of digital sidebands used by the HD Radio broadcaster.

13. The method in claim 12, wherein the content source is an HD Radio broadcaster, and the selected digitally encoded content for the analog modulated signal that differs from the digitally encoded content used by the HD Radio broadcaster for a main program signal.

14. The method of claim 11, wherein the content source is a network operations center.

15. The method of claim 11, wherein:

the protocol data units comprise layer 2 protocol data units.

16. The method of claim 11, further comprising:

modifying audio processing of the selected digitally encoded content.

17. The method of claim 10, further comprising: reordering data in the digitally encoded contents.

18. The method of claim 10, further comprising: replacing bits in the digitally encoded contents.

19. A method of distributing content, the method comprising:

transmitting a bit stream of unmodulated HD Radio Layer 2 data over a network, the data representing a plurality of digitally encoded contents and control information formatted according to an HD Radio protocol;

receiving the unmodulated HD Radio Layer 2 data at a player;

using processing circuitry in the player to decode the bit stream to recover the contents and control information;

supplying user commands to the processing circuitry; and producing an audio output based on one of the contents in response to the user commands.

20. The method of claim 19, wherein the contents includes a plurality of programs and the audio output is based on one of the programs selected by the user commands.

* * * * *